US007441923B2

(12) United States Patent
Hünerbein et al.

(10) Patent No.: US 7,441,923 B2
(45) **Date of Patent: *Oct. 28, 2008**

(54) OPERATING ROOM LIGHT FIXTURE AND HANDLE WITH CONTROL ELEMENT

(75) Inventors: Margret Hünerbein, Lübeck (DE); Ryzard Kummerfeld, Lübeck-Travemünde (DE); Georg Schlör, Sereetz (DE); Joachim Schröter, Lübeck (DE); Ingolf Diez, Tuttlingen (DE)

(73) Assignee: Dräger Medical AG & Co. KGaA, Lübeck (DE)

( * ) Notice: Subject to any disclaimer, the term of this patent is extended or adjusted under 35 U.S.C. 154(b) by 140 days.

This patent is subject to a terminal disclaimer.

(21) Appl. No.: 11/211,007

(22) Filed: Aug. 24, 2005

(65) Prior Publication Data

US 2006/0109664 A1 May 25, 2006

(30) Foreign Application Priority Data

Nov. 19, 2004 (DE) ..... 10 2004 055 838

(51) Int. Cl.
*F21S 10/00* (2006.01)
*F21V 19/02* (2006.01)

(52) U.S. Cl. ..... 362/241; 362/240; 362/247; 362/304; 362/293; 323/905

(58) Field of Classification Search ..... 362/240, 362/241, 247, 304, 2, 293; 323/905
See application file for complete search history.

(56) References Cited

U.S. PATENT DOCUMENTS

| | | | | | |
|---|---|---|---|---|---|
| 2,002,313 | A * | 5/1935 | Doane | 362/279 |
| 2,215,634 | A * | 9/1940 | Collins et al. | 250/495.1 |
| 2,356,592 | A * | 8/1944 | Kolbert et al. | 362/33 |
| 2,896,066 | A * | 7/1959 | Quetin | 362/33 |
| 4,135,231 | A * | 1/1979 | Fisher | 362/269 |
| 4,280,167 | A * | 7/1981 | Ellett | 362/33 |
| 4,316,237 | A * | 2/1982 | Yamada et al. | 362/33 |
| 4,651,257 | A * | 3/1987 | Gehly | 362/33 |
| 4,884,008 | A * | 11/1989 | Bossler et al. | 315/152 |
| 5,001,616 | A * | 3/1991 | Gehly et al. | 362/308 |
| 5,067,064 | A * | 11/1991 | Gehly et al. | 362/277 |
| 5,331,530 | A * | 7/1994 | Scholz | 362/293 |
| 5,951,139 | A * | 9/1999 | Smith et al. | 362/33 |
| 6,135,602 | A * | 10/2000 | Chuang | 362/33 |
| 6,402,351 | B1 | 6/2002 | Borders | |
| 6,443,596 | B1 * | 9/2002 | Bulko et al. | 362/293 |
| 6,572,234 | B1 | 6/2003 | Maier et al. | |
| 6,582,092 | B1 | 6/2003 | Marka | |
| 2003/0165055 | A1 | 9/2003 | Scholz | |
| 2006/0109650 | A1 * | 5/2006 | Hunerbein et al. | 362/251 |

* cited by examiner

*Primary Examiner*—Ismael Negron
(74) *Attorney, Agent, or Firm*—McGlew & Tuttle, P.C.

(57) ABSTRACT

An operating room light fixture with a light fixture housing, in which at least one lighting unit with at least one light source is arranged, with a handle, which is arranged on a side of the light fixture housing facing the operating area, wherein the handle comprises a control element for setting and/or adjusting the luminous intensity of the light source.

17 Claims, 3 Drawing Sheets

OPERATING ROOM LIGHT FIXTURE AND HANDLE WITH CONTROL ELEMENT

CROSS REFERENCE TO RELATED APPLICATIONS

This application claims the benefit of priority under 35 U.S.C. § 119 of DE 10 2004 055 838.8 filed Nov. 19, 2004, the entire contents of which are incorporated herein by reference.

FIELD OF THE INVENTION

The present invention pertains to an operating room light fixture with a light fixture housing, in which at least one lighting unit with at least one light source is arranged, with a handle, which is arranged on the side of the light fixture housing facing the operating area.

Furthermore, the present invention pertains to a device for actuating an operating room light fixture with a control unit for switching over from a first lighting unit having a first light source and an external reflector to a second lighting unit having a second light source and an internal reflector.

BACKGROUND OF THE INVENTION

An operating room light fixture with two lighting units is known from DE 199 56 337 A1, wherein a first lighting unit having a first light source and an external reflector is arranged in front of a second lighting unit having a second light source and an internal reflector in the direction in which the light emerges. The operating room light fixture has a control unit, which switches over to the second lighting unit as a function of a sensor signal, which detects the failure of the first lighting unit. The first lighting unit acting as the main lighting unit is replaced now because of its defect by the second lighting unit as a reserve lighting unit.

An operating room light fixture with a light fixture housing, in which a lighting unit with a light source is arranged, is known from DE 101 19 215 A1. On the side facing the operating area, the light fixture housing has a handle, by means of which the operator (surgeon) can direct the lighting unit toward the surface to be lit in the operating area. The operating room light fixture is fastened to a ceiling of the operating room by means of a suspension in an articulated manner. Control elements are provided in a wall box fastened to a wall of the operating room for the remote control of the operating room light fixture, the control signals being transmitted to the operating room light fixture by means of a transmitter-receiver unit in a wireless manner. The drawback of the prior-art operating room light fixture is the relatively limited operating comfort.

SUMMARY OF THE INVENTION

The object of the present invention is therefore to provide an operating room light fixture and a device for actuating same, so that the operating comfort is improved and better illumination of the operating area is guaranteed.

According to the invention, an operating room light fixture is provided with a light fixture housing, in which at least one lighting unit with at least one light source is arranged, with a handle, which is arranged on a side of the light fixture housing facing the operating area. The handle comprises a control element for setting and/or adjusting the luminous intensity of the light source.

The special advantage of the operating room light fixture according to the present invention is that the operator (surgeon) can set two functions of the operating room light fixture simultaneously by operating the operating room light fixture at one site. On the one hand, he can direct the operating room light fixture toward the operating area in space by grasping the handle, so that improved illumination of the operating area is guaranteed. On the other hand, the operator can set or adjust the luminous intensity of the light source by operating the control element integrated in the handle, so that optimal illumination of the operating area can be performed relatively simply and rapidly.

According to a preferred embodiment of the present invention, the control element is designed as a rotary element, so that the luminous intensity of the light source can be adapted to the needs by rotation in an easy-to-operate manner.

According to a special embodiment of the present invention, the handle is designed such that it can be sterilized. The control element is advantageously arranged in a central handle, which has a sterile design and thus makes possible the independent control of the light fixture by the sterile operating personnel.

According to a variant of the present invention, the control unit is arranged at the light fixture housing, so that the control of the operating room light fixture, the actuating unit of the operating room light fixture and the lighting unit of the operating room light fixture are arranged in or at a common housing. The operating room light fixture has a compact design as a result.

According to a variant of the present invention, a first lighting unit with a first light source and with an external reflector associated with same and a second lighting unit with a second light source and with an internal reflector associated with same are provided. The first lighting unit is used to generate a surface light, while the second lighting unit is used to achieve an additional in-depth illumination. As a result, it is advantageously unnecessary to bundle the light to achieve in-depth illumination. A constant light field diameter is always obtained due to the combination of the lighting units.

According to this further aspect of the invention the first light source of the first lighting unit and the second light source of the second lighting unit can be interconnected, such that an optical variable is set between a minimum and a maximum according to a preset control curve by actuating the single control element.

The special advantage of the device according to the present invention is that two lighting units can be actuated by means of a preset control mode such that illumination of the operating area corresponding to the needs is made possible.

According to a preferred embodiment of the device according to the present invention, the luminous intensity of the operating room light fixture is used as the actuating variable, so that adaptation of the luminous intensity is guaranteed with the combination of at least two lighting units. The in-depth illumination of the operating room light fixture can be optionally improved with the second lighting unit.

According to a variant of the device according to the present invention, the first and second lighting units are superimposed at least in one area of the control curve, which can be used especially to change the in-depth illumination.

According to a variant of the present invention, the control of the lighting units can be performed by means of a central handle arranged on a side of the operating room light fixture facing the operating area to be illuminated or by means of a stationarily arranged wall-mounted control unit. The wall-mounted control unit may be connected with the control unit arranged in the light fixture housing of the operating room light fixture in a wireless manner or via a cable.

An exemplary embodiment of the present invention will be explained in greater detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 1:
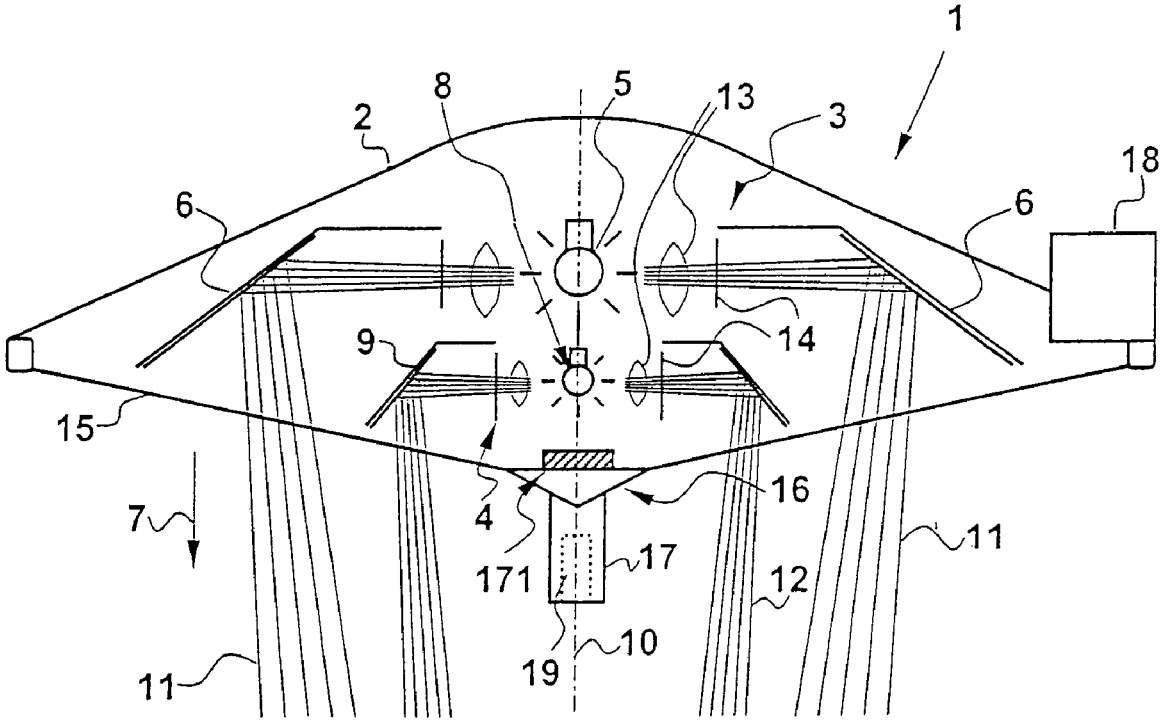
FIG. 1 is a schematic vertical section through an operating room light fixture.

Referring to the drawings in particular, an operating room light fixture 1 is provided according to the present invention. The operating room light fixture 1 is used, for example, in operating rooms of hospitals. The operating room light fixture 1 comprises essentially a light fixture housing 2, in which a first lighting unit 3 and a second lighting unit 4 are arranged. The light fixture housing 2 is fastened to a ceiling of the operating room via a suspension, not shown, the adjustment in space of the light fixture housing 2 being guaranteed by pivot bearings.

The first lighting unit 3 has a first light source 5 and an external reflector 6 associated with same. The second lighting unit 4 is arranged in front of the first lighting unit 3 in the direction 7 in which the light emerges and has a second light source 8 as well as an internal reflector 9 associated with same.

The first light source 5 and the second light source 8 are arranged on a common optical axis 10 of the operating room light fixture 1. The first light source 5 is designed as a gas discharge lamp and generates a first light bundle 11 with the relatively large-area external reflector 6 to form a shadowless surface light. The second light source 8 is designed as a halogen lamp and generates, in cooperation with the relatively small-area internal reflector 9, a second light bundle 12 to generate an additional in-depth illumination. A lens 13 for guiding the light as well as a filter 14, which are arranged between the light sources 5, 8 and the reflectors 6, 9, are associated with the light sources 5, 8. The filter 14 is used to absorb the infrared radiation.

A side on which the light emerges 15 of the light fixture housing 2 is formed essentially by a transparent glass pane. A handle 17 projects downward from the side on which the light emerges 15 in a central area 16 of the side on which the light emerges 15. The handle 17 is designed as a rotary element (control element) and is used to operate the first lighting unit 3 and the second lighting unit 4. The handle 17 is mounted rotatably around an axis of rotation, which coincides with the optical axis 10. The axis of rotation is directed in parallel to the direction 7 in which the light emerges. The handle 17 is connected with a relative incremental transducer 171, which sends an electric signal to a control unit 18 of the operating room light fixture 1. A camera 19 may optionally also be installed in the handle 17. The handle 17 is designed such that it can be sterilized and makes possible the direct operation of the lighting units 3, 4 by the operator (surgeon). As a result, direct adjustment (optically and in space) of the operating area by the operator is guaranteed.

The incremental transducer 171 may be designed without a stop. The incremental transducer 171 may optionally have a mechanical lock for certain angle of rotation segments.

The control unit 18 is preferably arranged at the light fixture housing 2. As an alternative, it may also be arranged on a suspension, not shown.

Figure 2:
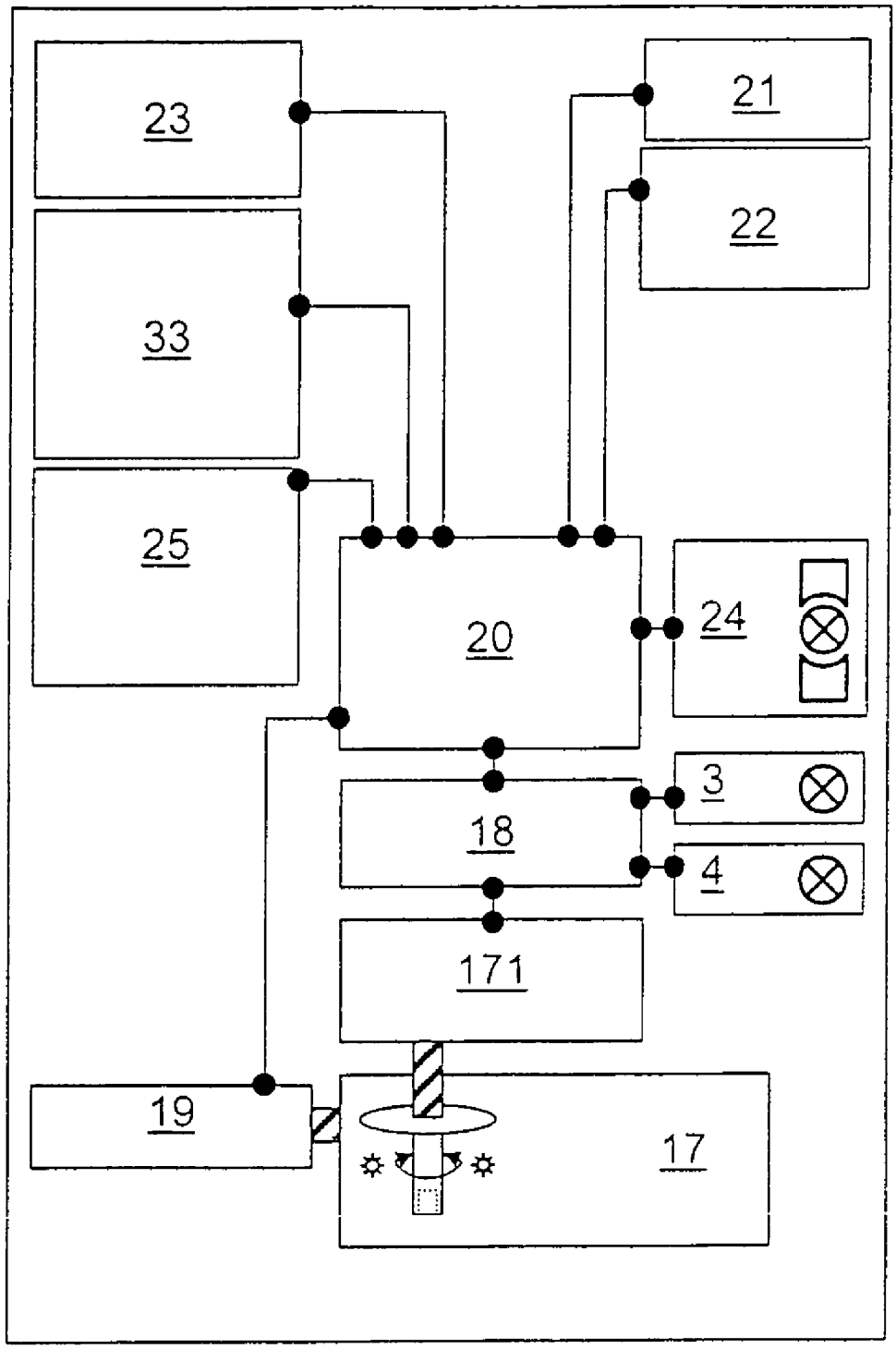
FIG. 2 is a block diagram of the operating room light fixture.

As is apparent from FIG. 2, a power supply unit 20, which is preferably fastened directly to the ceiling tube on a side of the suspension facing the ceiling of the operating room, is electrically connected with the control unit 18. The power supply unit 20 makes possible the automatic switching of the power supply of the connected functional units from line-powered operation 21 to an emergency power generator 22 present in the building.

Moreover, the power supply unit 20 may be connected with a stationarily arranged control unit 23. This control unit 23 is preferably fastened to a wall and is used to operate the lighting units 3 and 4 as well as to operate an additional indirect illuminating unit 24, which is arranged on the suspension or on a top side of the light fixture housing 2. This additional illuminating unit generates a diffuse light in order to set a certain basic brightness in the operating room when the lighting units 3, 4 are switched off, without the surgical procedure being hindered. This additional illuminating unit 24 is used for indirect illumination for microinvasive surgery.

The control unit 23 is coupled with the power supply unit 20 via an electric line, which passes on the electric signals to the power supply unit 20 and the control unit 18 via sliding contacts in the hinges of the suspension without stops. The control unit 23 is thus used for nonsterile control just as the control by means of an interface 25 (RS-232 interface) integrated in the power supply unit 20. This interface 25 may be arranged either at the ceiling tube or at an external switch box. It makes possible the coupling of a control unit, not shown, via a USB cable or in a wireless manner by means of infrared radiation. In addition, a wall-mounted control unit 33 may be provided for controlling the camera 19.

The additional illuminating unit 24 can be actuated directly by the power supply unit 20, wherein the first and second lighting units 3 and 4 can be actuated via the control unit 18. The handle 17 is mechanically connected with the incremental transducer 171 and with the camera 19.

Figure 3:
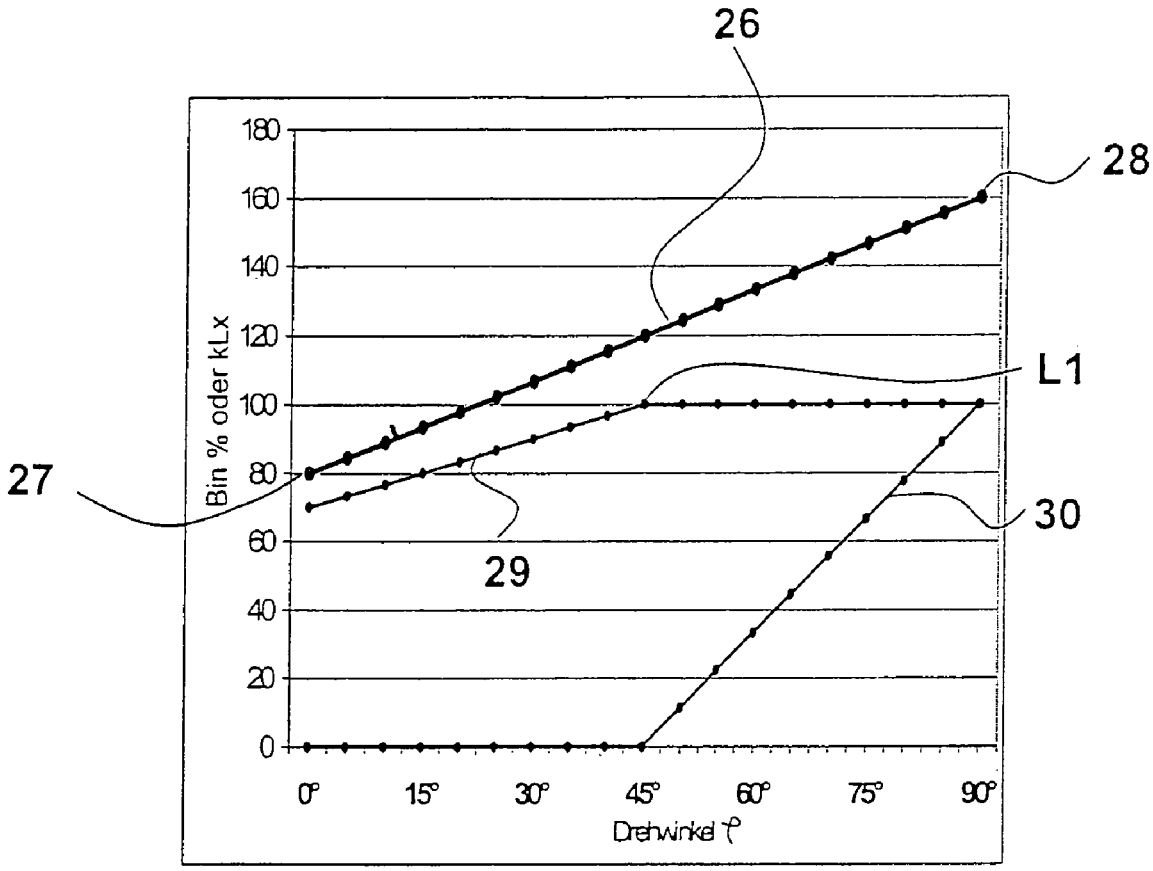
FIG. 3 is a graphic view of a control curve for the actuation of the operating room light fixture.

FIG. 3 shows a control curve 26, according to which the luminous intensity B delivered to the operating area is emitted by the operating room light fixture 1 as a function of an angle of rotation $\phi$ of the handle 17, 171. The control curve 26 is a total luminous intensity curve that has essentially a linear course and extends from a minimum 27, which corresponds to the angle position $\phi=0°$ to a maximum 28, which corresponds to an angle of rotation value of $\phi=90°$. The total luminous intensity curve or control curve 26 is obtained from a superimposition of the first lighting unit 3 and the second lighting unit 4, wherein only the first lighting unit 3 with its luminous intensity curve 29 contributes to the generation of the resulting total luminous intensity curve or control curve 26 in a first luminous intensity range in an angle of rotation range of $\phi$ between 0° and 45°, i.e., the second lighting unit 4 is switched off The second lighting unit 4 is superimposed to the first lighting unit 3 in a second luminous intensity range, which extends in an angle of rotation range between $\phi=45°$ and $\phi=90°$, the lighting unit 4 having a linear luminous intensity curve 30, while the luminous intensity curve 29 of the first lighting unit 3 remains constant at 100%. The control curve 26 of the combined lighting units 3, 4 is expressed in kiloLux (kLx). The luminous intensity curves 29, 30 of the first lighting unit 3 and of the second lighting unit 4 are expressed as percentages relative to the nominal luminous intensity of the respective lighting unit 3, 4. The luminous intensity curve 29 rises from 70% to 100% of the maximum luminous intensity in the first illumination range. As a result, the luminous intensity can be adjusted in the first illumination range between 80 kLx and 120 kLx.

The lighting units 3, 4 of the operating room light fixture 1 are controlled as follows: When the operating room light fixture 1 is switched on, the first lighting unit 3 has its maximum luminous intensity value L1. The second lighting unit 4 is switched off. The handle 17 assumes such a position that it corresponds to an angle of rotation of $\phi=45°$. By rotating the handle 17 in a first direction, the luminous intensity 30 of the second lighting unit 4 can be superimposed to the luminous intensity 29 of the first lighting unit 3, angle of rotation range 45° to 90° in FIG. 3. The maximum angle of rotation is 45°. The maximum 28 of the luminous intensity curve 26, at which both lighting units 3 and 4 have reached 100% of their nominal luminous intensities (approx. 160 kLx), is reached in this position.

The handle 17 may be optionally rotated beyond the maximum angle of rotation of 45° in the first direction of rotation, for which case a mechanical lock is provided. Switching is performed now in a pure in-depth illumination mode, in which the first lighting unit 3 is dimmed to the extent possible or is switched off.

When the handle 17 is rotated in a second direction of rotation opposite the first direction after switching on the operating room light fixture 1, the overall luminous intensity 26 is determined exclusively by the luminous intensity curve 29 of the first lighting unit 3. The first lighting unit 3 is actuated in this first luminous intensity range such that starting from a switch-on angle 45°, the luminous intensity 29 is reduced in an angle range totaling 45° to approx. 70% of the nominal luminous intensity of the first lighting unit 3. This corresponds to about 80 kLx, the minimum 27 of the total luminous intensity curve 26.

A mechanical lock, which signals to the operator the switching on of the additional illuminating unit 24, may be optionally provided during the further rotation of the handle 17 beyond the angle of rotation range of 45° in the first luminous intensity range. The first lighting unit 3 can be dimmed now, and the radiation from the light fixture housing 2 in the direction of the operating area is very extensively hindered. The illumination takes place in this state of switching essentially by the additional illuminating unit 24. This can be brought about, for example, by moving up the first light source 5, and the light is radiated upward by means of an auxiliary reflector. As an alternative, the emergence of the light radiation in the direction of the operating area can be hindered by covering the first lighting unit in the downward direction.

According to an alternative of the operating room light fixture 1, not shown, the control unit 18 may also actuate the lighting units 3, 4 such that the first illumination range and the second illumination range comprise a different angle of rotation range or more than two illumination ranges are provided. The luminous intensity curves 29, 30 of the lighting units 3, 4 may also be combined such that a nonlinear course of the control curve 26 is obtained. For example, the control unit 18 may actuate the lighting units 3, 4 such that the second lighting unit 4 is switched on additionally already beginning from an angle of rotation $\phi$ at which the first lighting unit 3 has not yet reached its maximum nominal luminous intensity.

As an alternative, other optical variables of the lighting units 3, 4 may also be combined with one another.

As an alternative, the first lighting unit 3 and the second lighting unit 4 may also have light sources 5, 8 of the same type with equal or different nominal power.

While a specific embodiment of the invention has been shown and described in detail to illustrate the application of the principles of the invention, it will be understood that the invention may be embodied otherwise without departing from such principles.

What is claimed is:

1. An operating room light fixture with actuating device, comprising:

a first lighting unit having a first light source and an external reflector;

a second lighting unit having a second light source and an internal reflector;

a control unit for varying and setting the luminous intensity of the first light source and the second light source, wherein said first light source of said first lighting unit and said second light source of said second lighting unit are operatively interconnected by said control unit; and a single control element connected to said control unit such that a luminous intensity of the operating room light fixture is set between a minimum and a maximum of said first light source of said first lighting unit and said second light source of said second lighting unit within a control element actuation range according to a preset control curve by actuating said single control element.

2. An operating room light fixture with actuating device in accordance with claim 1, wherein said control curve represents a linear luminous intensity curve.

3. An operating room light fixture with actuating device in accordance with claim 1, wherein said single control element for controlling said first lighting unit and said second lighting unit is arranged directly connected to a handle projecting downward from a light fixture housing or at a stationarily arranged wall mount.

4. An operating room light fixture with actuating device in accordance with claim 1, wherein said first light source of said first lighting unit and said second light source of said second lighting unit are interconnected by means of said control unit such that only said first lighting unit contributes to the total luminous intensity delivered in the direction of the operating area in a first luminous intensity range, and said second lighting unit is superimposed to said first lighting unit in a second illumination range.

5. An operating room light fixture with actuating device in accordance with claim 4, wherein at a beginning of said second illumination range, said second lighting unit is additionally connected to said first lighting unit, wherein the luminous intensity of said first lighting unit is constant and the luminous intensity of said second lighting unit is variable in the second luminous intensity range, and the luminous intensity of said second lighting unit is constant and the luminous intensity of said first lighting unit is variable in the first luminous intensity range.

6. An operating room light fixture, comprising:

a light fixture housing;

a first lighting unit with a first light source, said first lighting unit being arranged in said housing, said first lighting unit having a first lighting unit reflector radially outward of said first light source;

a second lighting unit with a second light source, said second lighting unit being arranged in said housing with said second light source substantially coaxial with said first light source, said second lighting unit having a second lighting unit reflector radially outward of said second light source and radially inward of said first lighting unit reflector and directing emitted light axially outwardly;

a control unit connected to said first lighting unit and said second lighting unit for controlling a luminous intensity of said first lighting unit and for controlling a luminous intensity of said second light unit; and a handle arranged on a side of the light fixture housing facing the operating area and substantially coaxial with said first light source and said second light source, said handle comprising a control element connected to said control unit with a single range of control for setting and/or adjusting the luminous intensity of the first light source and the second light source within a single luminous intensity range including a variable luminous intensity of said first light source and a variable luminous intensity of said second light source with said variable luminous intensity of said second light source superimposed on said variable luminous intensity of said first light source within said single range of control.

7. An operating room light fixture in accordance with claim 1, wherein the handle comprises an element that can be sterilized.

8. An operating room light fixture in accordance with claim 1, wherein said control unit is arranged at the light fixture housing connected thereto.

9. An operating room light fixture in accordance with claim 1, wherein the second light source reflector of the second lighting unit is arranged in front of the first light source reflector of the first lighting unit in the direction in which the light emerges, and the second light source of the lighting unit is arranged directly in front of the first light source in the direction in which the light emerges.

10. An operating room light fixture in accordance with claim 1, wherein said control element is a rotary element for setting and/or adjusting the luminous intensity of the light source by rotation of said rotary element.

11. An operating room light fixture in accordance with claim 10, wherein the rotary element comprises a relative incremental transducer or a potentiometer, which sends an electric signal to said control unit.

12. An operating room light fixture, comprising:

a light fixture housing;

a first lighting unit with a first light source, said lighting unit being arranged in said housing, said first lighting unit having a first lighting unit reflector radially outward of said first light source;

a second lighting unit with a second light source, said second lighting unit being arranged in said housing with said second light source substantially coaxial with said first light source, said second lighting unit having a second lighting unit reflector radially outward of said second light source and radially inward of said first lighting unit reflector and directing emitted light axially outwardly;

a control unit connected to said first lighting unit and said second lighting unit for controlling a luminous intensity of said first lighting unit and said second lighting unit; and a rotary element connected to said control unit for setting and/or adjusting the luminous intensity of the first light source and the second light source by rotation of said rotary element within a single control range to provide a single variable luminous intensity range incorporating a full variation of said first light source and a full variation of said second light source with said full variation of said second light source being superimposed on a variable or fixed intensity of said first light source within said single variable luminous intensity range, said rotary element comprising a handle arranged on a side of the light fixture housing facing the operating area and coaxial with said first light source and said second light source.

13. An operating room light fixture in accordance with claim 12, wherein the rotary element further comprises a relative incremental transducer or a potentiometer, which sends an electric signal to said control unit.

14. An operating room light fixture in accordance with claim 13, wherein said handle is removably connected to the light fixture adjacent said light fixture housing and comprises an element that can be sterilized.

15. An operating room light fixture in accordance with claim 14, wherein said control unit is arranged at the light fixture housing connected thereto.

16. An operating room light fixture in accordance with claim 13, wherein the second light source reflector of the second lighting unit is arranged in front of the first light source reflector of the first lighting unit in the direction in which the light emerges, and the second light source of the lighting unit is arranged directly in front of the first light source in the direction in which the light emerges.

17. An operating room light fixture in accordance with claim 16, wherein the second light source and the first light source are coaxial with said handle and said handle is arranged in front of the first light source of the first lighting unit in the direction in which the light emerges and said handle is arranged directly in front of the second light source of the second lighting unit in the direction in which the light emerges.

* * * * *